US005528801A

United States Patent [19]

Hasegawa

[11] Patent Number: 5,528,801

[45] Date of Patent: Jun. 25, 1996

[54] STRINGER TAPE AND SLIDE FASTENER INCORPORATING THE SAME

[75] Inventor: Akira Hasegawa, Kurobe, Japan

[73] Assignee: YKK Corporation, Tokyo, Japan

[21] Appl. No.: 298,174

[22] Filed: Aug. 30, 1994

[30] Foreign Application Priority Data

Sep. 10, 1993 [JP] Japan ..... 5-226137

[51] Int. Cl.[6] ..... A44B 19/00

[52] U.S. Cl. ..... 24/403; 24/394; 24/395

[58] Field of Search ..... 24/403, 404, 405, 24/415, 392, 394, 395, 389

[56] References Cited

U.S. PATENT DOCUMENTS

| | | | |
|---|---|---|---|
| 1,701,555 | 2/1929 | Binns | 24/405 |
| 3,908,242 | 9/1975 | Reynolds | 24/395 |
| 4,022,034 | 5/1977 | Matsuda | 24/394 |
| 4,495,679 | 1/1985 | Scarpini | 24/403 |

FOREIGN PATENT DOCUMENTS

| | | |
|---|---|---|
| 59-25215 | 7/1984 | Japan . |
| 63-30245 | 8/1988 | Japan . |

*Primary Examiner*—Victor N. Sakran

*Attorney, Agent, or Firm*—Hill, Steadman & Simpson

[57] ABSTRACT

A slide fastener comprising a pair of stranger tapes, each including an elongated tape body including a plurality of warp threads and a beaded longitudinal edge portion provided on one longitudinal edge of the elongated tape body, the beaded marginal portion including a tube formed integrally with the elongated tape body and a plurality of filler threads inserted through the tube in such a way not to be intertwined with each other, the filler threads being identical in denier with the warp thread; and two rows of coupling elements extruded from plastics and each mounted on the respective beaded edge, each element comprising a coupling head and a pair of clamping legs extending rearward from the coupling head, each row of coupling elements being connected with two connecting rods embedded in the legs, each element clamp-mounted on the beaded edge with the legs sewn to the beaded edge by sewn stitches.

4 Claims, 2 Drawing Sheets

STRINGER TAPE AND SLIDE FASTENER INCORPORATING THE SAME

BACKGROUND OF THE INVENTION

1. Field of the Invention

The present invention relates to a stringer tape having a beaded edge along its one longitudinal edge, the beaded edge including a tube integrally formed along the longitudinal edge of the stringer tape and a filler thread or filler threads inserted through the tube, and also relates to a slide fastener including a pair of such stringer tapes and two rows of coupling elements extrusion-molded from plastic and sewn to the respective longitudinal edges of the stringer tapes.

2. Description of the Prior Art

Heretofore, it has been commonly known in this field that, in order to provide a longitudinal beaded edge on the stringer tape, intertwined yarns are sewn to, woven into or knitted into a longitudinal edge of the stringer tape.

A typical stringer tape of the type described is disclosed in Japanese Utility Model Publication No. 59-25215. In this conventional stringer tape, a longitudinal beaded edge is provided in the following way; first, a reinforcing filler comprised of an elongated central core and a warp-knit tube surrounding the elongated central core and extending longitudinally therewith is provided. The warp-knit tube has on its periphery a plurality of longitudinal wales. Secondly, such a reinforcing filler is inserted through a woven tube formed along one longitudinal edge of the stringer tape. Thirdly, the woven tube is heat-set and thus shrunk to clench the inside warp-knit tube therein.

Furthermore, Japanese Utility Model Publication No. 63-30245 discloses a slide fastener comprising a pair of stringer tapes and two coupling element rows mounted on the opposed inner longitudinal edges of the stringer tapes. The coupling element rows are made from plastics through an extrusion-molding process. Each element row is folded back on itself to provide a U-shape to cause each element to have opposed upper and lower legs. Every second element is connected by an integral connecting portions alternately at the upper leg and the lower leg. In addition to being integrally connected, the coupling elements are connected together with connecting rods embedded in the upper and lower legs. Then, the U-shaped element row is clamped to the longitudinal edge of the relevant stringer tape. Eventually, the U-shaped element row is sewn to the stinger tape.

The stringer tape according to the first-mentioned Japanese Utility Model Publication suffers from drawbacks. Since the woven tube is heat-set and thus shrunk to clench the inside warp-knit tube therein, the longitudinal beaded edge is made too rigid, thus lacking in resiliency and flexibility. Furthermore, for the same reason, the rigid beaded edge is disinclined to be pierced by sewing needles so that, although this stringer tape lends itself to metal coupling elements which are mechanically clamped to the longitudinal edge of the stinger tape, it is extremely difficult if not completely impossible to sew discrete plastic coupling elements to this stringer tape. Furthermore, even if this stringer tape is used on metal coupling elements, it still has a disadvantage in that, since the U-shaped coupling elements are clamped to the thick and rigid beaded edges, which will be less likely to squeeze, the slide fastener as a whole is made considerably thick, which goes against the recent fashion in this field wherein a thinner slide fastener has been sought.

The slide fastener according to the second-mentioned Japanese Utility Model Publication also suffers from drawbacks. Every second element is integrally connected to each other by the connection portion alternately at the upper leg and the lower leg. In addition to being integrally connected, the individual elements are connected together with connecting rods embedded in the upper and lower legs. As a result, the coupling element row is stiff, so that the slide fastener as a whole lacks in flexibility.

Furthermore, the stringer tape has no beaded edge along an inner longitudinal edge, therefore being flat, so that the coupling element row mounted to the flat longitudinal edge is liable to become detached or displaced from the flat longitudinal edge of the stringer tape. For the same reason, it is quite difficult to firmly mount a separating device to the lower end of the opposed longitudinal edges.

SUMMARY OF THE INVENTION

With the foregoing difficulties in view, it is an object of the present invention to provide a stringer tape for slide fasteners whose longitudinal edge portion is suitable to carry either plastic extrusion-molded elements, extrusion-molded elements, or metal elements, the longitudinal beaded edge portion being so resilient and flexible that it is easy to mount the coupling elements to the longitudinal beaded edge portion and furthermore the slide fastener as a whole is flexible.

It is another object of the present invention to provide a slide fastener wherein coupling elements are extrusion-molded from plastic and a stringer tape with a longitudinal beaded edge portion is made separately, then the coupling elements are clamped to the longitudinal beaded edge potion, and wherein the slide fastener is further provided with a separating device which could not have been mounted on the conventional extrusion-molded element rows.

According to one aspect of the present invention, there is provided a stringer tape for slide fasteners comprising: an elongated tape body including a plurality of warp threads and a beaded longitudinal edge portion provided on one longitudinal edge of the elongated tape body, the longitudinal beaded edge portion including a tube formed integrally with the elongated tape body and a plurality of filler threads inserted through the tube in such a way not to be intertwined with each other, the filler threads being substantially identical in denier with the warp thread.

According to another aspect of the present invention, there is provided a slide fastener comprising; a pair of stringer tapes, each including an elongated tape body including a plurality of warp threads and a beaded longitudinal edge portion provided on one longitudinal edge of the elongated tape body, the beaded marginal portion including a tube formed integrally with the elongated tape body and a plurality of filler threads inserted through the tube in such a way not to be intertwined with each other, the filler threads being substantially identical in denier with the warp thread; and two rows of discrete coupling elements extrusion-molded from plastics and each mounted on the respective longitudinal beaded edge, each discrete coupling element comprising a coupling head and a pair of clamping legs extending rearward from the coupling head, each row of coupling elements being connected with two connecting rods embedded in the respective legs, each element clamp-mounted on the longitudinal beaded edge with the legs sewn to the longitudinal beaded edge by sewn stitches; a stringer tape for slide fasteners comprising: an elongated tape body including a plurality of warp threads and a beaded longitudinal edge portion provided on one longitudinal edge of the elongated tape body, the beaded marginal portion including a tube formed integrally with the elongated tape body and a plurality of filler threads inserted through the tube in such a way not to be intertwined with each other, the filler threads being identical in denier with the warp thread.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Some preferred embodiments of the invention will be closely described hereinbelow in conjunction with the drawings appended hereto.

Figure 3:
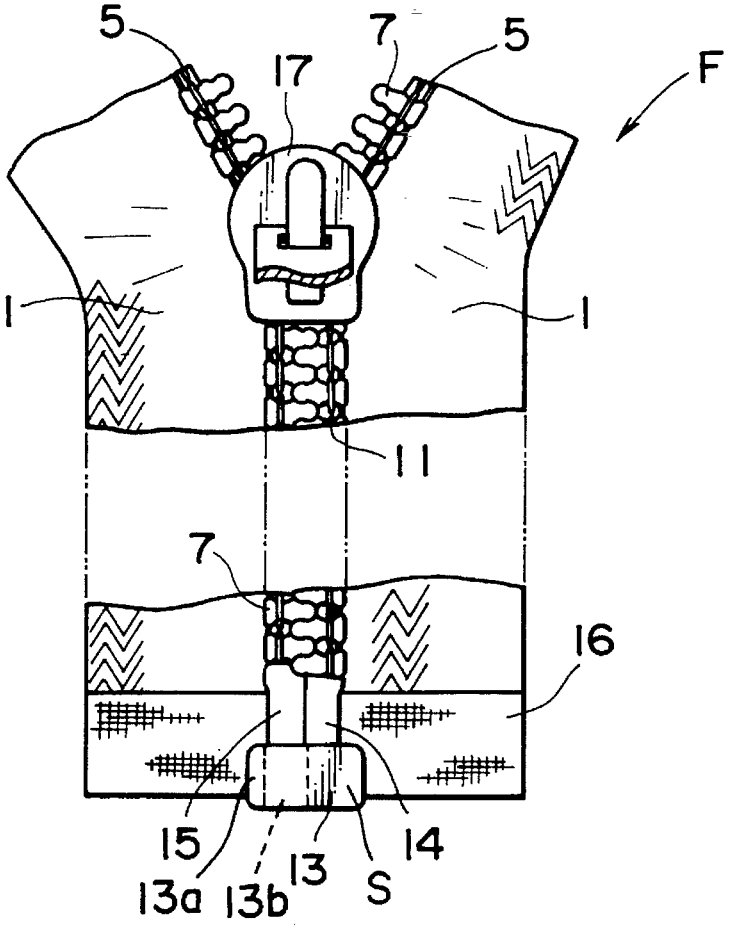
FIG. 3 is a front view, partly cutaway, of a separable type of slide fastener having extrusion-molded discrete coupling elements and a separating device as well.

As better shown in FIG. 3, a slide fastener F according to the present invention is broadly comprised of a pair of stringer tapes 1, 1, two matching rows of discrete coupling elements 7, 7 mounted on the opposed longitudinal inner edges of the stringer tapes 1, 1 and a slider 17 reciprocally movable along the matching rows of coupling elements 7, 7, to couple and uncouple of the coupling element rows 7, 7 to open and close the slide fastener F. Since being of the separable type or the open-end type which can be separated from the bottom of the slide fastener F, the slide fastener F illustrated in FIG. 3 further includes a separating device S mounted on the lower end of the coupling element rows 7, 7. But, this invention can be used in a slide fastener of the closed end type wherein a usual bottom end stop is mounted on the lower end of the coupling element rows 7, 7. In the event of the closed end type slide fastener, the slide fastener cannot be separated from the bottom of the slide fastener.

Figure 4:
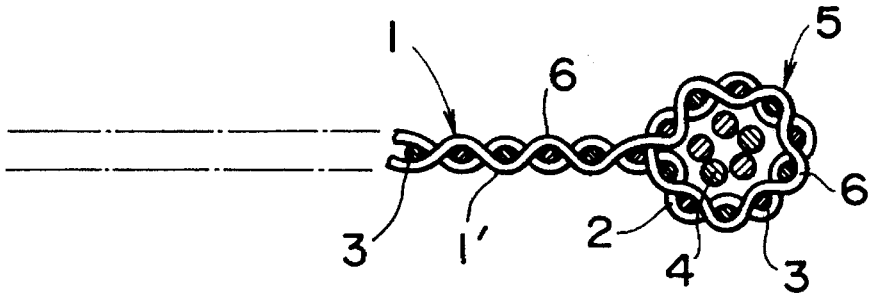
FIG. 4 is a cross-sectional view of a stringer tape before extrusion-molded discrete elements are mounted on a beaded edge thereof.

As shown in FIG. 4, each stringer tape 1 according to the present invention is broadly comprised of an elongated woven tape body 1' and a longitudinal beaded edge portion 5 provided on one or inner longitudinal edge of the elongated woven tape body 1'. The elongated woven tape body 1' is comprised of a plurality of warp threads 3 and a single weft thread 6 interlaced with the warp threads 3 with the weft thread 6 underlying and overlying the alternate warp threads 3.

As shown in FIG. 4, the beaded longitudinal edge portion 5 includes a woven tube 2 woven integrally with the elongated woven tape body 1'. The woven tube 2 is likewise comprised of a plurality of warp threads 3 and a single weft thread 6 interlaced with the warp threads 3 with the weft thread 3 underlying and overlying the alternate warp threads 6. The elongated beaded longitudinal edge portion 5 further includes a plurality of filler threads 4 inserted through the woven tube 2 in such a way not to be intertwined with each other. The warp threads 3, the filler threads 4 and the weft threads 6 may be either polyester yarns or polyester-and-natural fiber mixed yarns. The foregoing description has been made in reference to the woven stringer tape 1, however, the stringer tape may be made as a knitted tape.

The discrete coupling elements 7 are made of high impact-strength plastics such as polyamide, polypropylene, etc. through an extrusion-molding process. As better shown in FIG. 2, each discrete coupling element 7 is comprised of a coupling head portion 12 and a pair of upper and lower clamping legs 8, 8 extending oppositely from the head portion 12. As can be seen from FIGS. 1 and 2 together, the discrete coupling elements 7 are connected with two connecting rods 9, 9 at regular intervals, with each leg 8 having the respective connecting rod 9 embedded adjacent to its distal end. The connecting rods 9 are made of thermoplastics such as polyester. Each leg 8 has a recess 10 formed on the outer surface at the intermediate position. The element row 7 thus produced is folded back around the coupling heads 12 on itself to thus assume a U-shape. Then, as better shown in FIG. 2, the U-shaped coupling element row 7 is firmly clamped to the longitudinal beaded edge 5 of the stringer tape 1. Since the filler threads 4 are not intertwined, thus being so flexible, the longitudinal edge portion 5 is squeezed and contracted by clamping the coupling element row 7 to the longitudinal beaded edge 5, to thus advantageously provide a thinner slide fastener as a whole.

Then, the leg portions 8, 8 of each element are sewn to the longitudinal beaded edge 5 of the stringer tape 1 by sewn stitches running through the recesses 11 of the leg portions 8, 8. It is to be noted here that, since the plurality of filler threads 4 are inserted through the woven tube 2 in such a way not to be intertwined with each other, a needle is easy to pierce the longitudinal beaded edge 5, thus facilitating the operation of sewing the coupling element rows 7 to the stringer tapes 1. Furthermore, since the longitudinal beaded edge 5 is resilient and flexible, the longitudinal beaded edge 5 yields to the coupling heads 12 of the matching element rows 7 while coupling element rows 7 are coupled by a reciprocal movement of the slider 17, so that the slider 17 can reciprocate along the coupling element rows 7 very smoothly.

Since the discrete coupling elements 7 are interconnected by the connecting rods 9 in a row, they are much easier to sew to the longitudinal edge portion 5 of the stinger tape 10 than separate discrete elements. Furthermore, since the discrete elements 7 are connected to each other only by the flexible connecting rod 9, the slide fastener stringer is flexible, which help to make the reciprocal movement of the slider 17 smooth.

Figure 1:
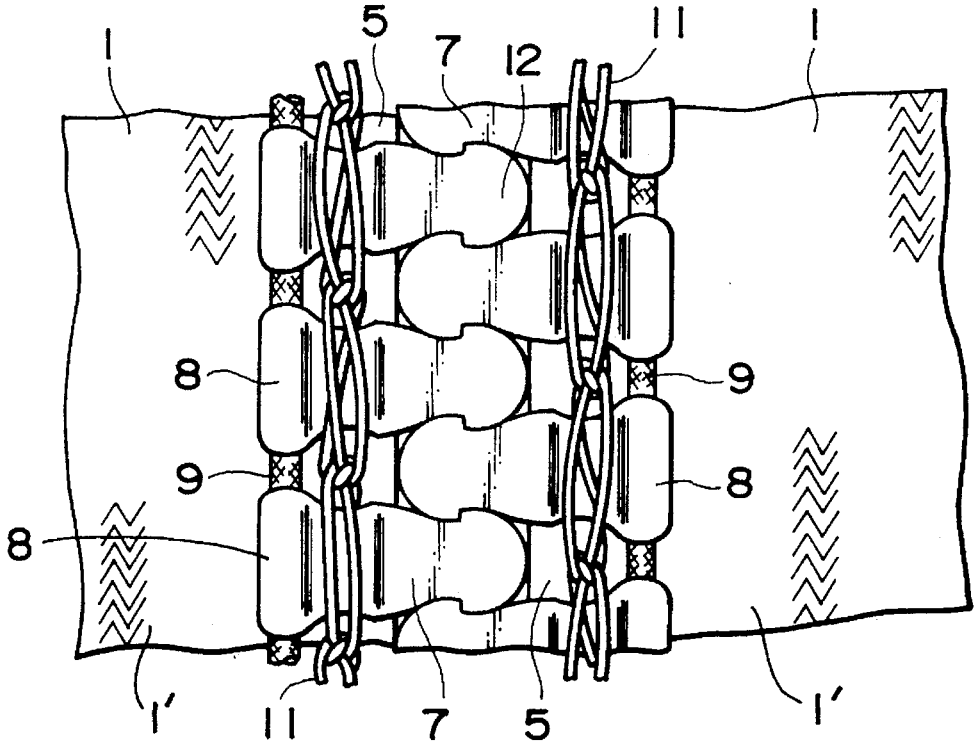
FIG. 1 is a fragmentary front view of a slide fastener carrying extrusion-molded discrete coupling elements.
Figure 2:
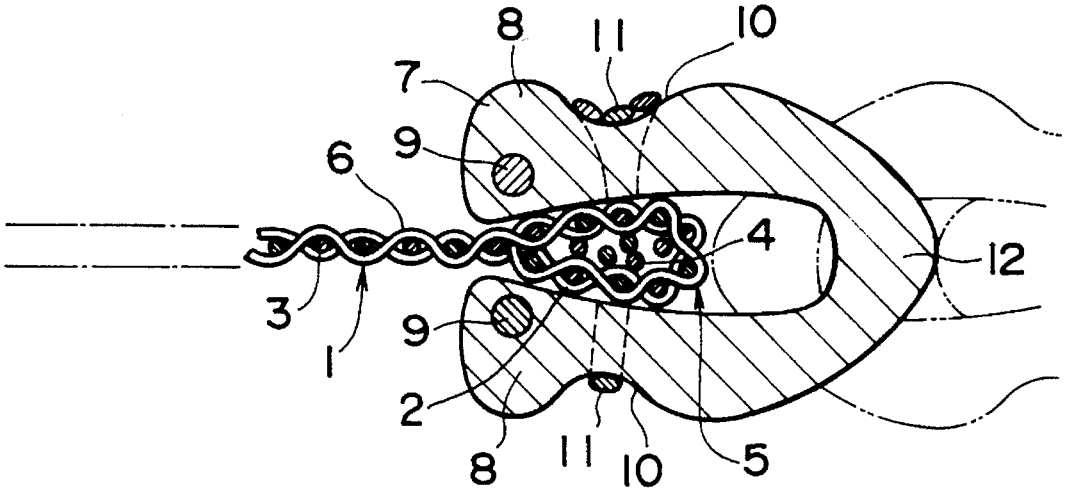
FIG. 2 is a cross-sectional view of one half of the slide fastener of FIG. 1, although a pan of the other matching half is shown in phantom lines.

As better shown in FIG. 1, the coupling head 7 and the distal end portions 8' of the leg 8 are widened lengthwise of the stringer tape 1.

FIG. 3 shows the open end type slide fastener provided at the lower end thereof with the separating device S. Specifically, the separating device S is generally comprised of a separating box 13 and an insert pin 15. The separating box 13 includes a box proper **13*a* and a box pin 14 fixedly mounted on the box proper 13*a* on the left side (as viewed in FIG. 3) so as to extend upward therefrom. The box proper 13*a* has an insert hole 13*b* formed on the right side to receive the insert pin 15 for coupling the matching coupling element rows 7, 7. The box pin 14 is mounted on the lower end of one of the longitudinal beaded edges 5 so as to continue from the relevant coupling element row 7. On the other hand, the insert pin 15 is mounted on the lower end of the other longitudinal beaded edge 5 so as to continue from the other coupling element row 7**.

The separating box 13 and the insert pin 15 of the separating device S may be made of either metal or plastics. A film 16 made of plastics such as polyethylene is fused or adhered to the lower end of each stringer tape 1 so as to prevent the stringer tape 1 from unraveling and to facilitate insertion of the insert pin 15 through the insert hole **13*b* of the separating box 13. The provision of the longitudinal beaded edge portion 5 on the stringer tape 1** permits the separating device S to be installed at the lower end of the slide fastener F, so that, the slide fastener F according to this invention, can be made either the open end type or the closed end type slide fasteners.

Partly because the discrete coupling elements 7 are fastened to the longitudinal beaded edge portion 5 by the sewn stitches 11 completely embedded in the recesses 10 of the coupling elements 7, and partly because the discrete coupling elements 7 are interconnected by the connecting rods 9 completely embedded in the leg portions 8 of the coupling elements 7; the discrete coupling elements 7 are quite exempt from being accidentally detached or displaced from the stringer tape 1.

Obviously, various modifications and variations of the present invention are possible in the light of the above teaching. It is therefore to be understood that within the scope of the appended claims the invention may be practiced otherwise than as specifically described.

What is claimed is:

1. A stringer tape for slide fasteners comprising:

an elongated tape body including a plurality of warp threads and a flexible beaded longitudinal edge portion provided on one longitudinal edge of the elongated tape body, the longitudinal beaded edge portion including a tube formed integrally with the elongated tape body and a plurality of filler threads inserted through the tube in such a way not to be intertwined with each other, said tube being oversized with respect to said filler threads to allow lateral spacing between the filler threads and an encircling inside surface of said tube, the filler threads being substantially identical in denier with the warp thread.

2. A slide fastener comprising;

a pair of stranger tapes, each including an elongated tape body including a plurality of warp threads and a beaded longitudinal edge portion provided on one longitudinal edge of the elongated tape body, the beaded marginal portion including a tube formed integrally with the elongated tape body and a plurality of filler threads inserted through the tube in such a way not to be intertwined with each other, the filler threads being substantially identical in denier with the warp thread; and two rows of discrete coupling elements extrusion-molded from plastics and each mounted on the respective longitudinal beaded edge, each discrete coupling element comprising a coupling head and a pair of clamping legs extending rearward from the coupling head, each row of coupling elements being connected with two connecting rods embedded in the respective legs, each element clamp-mounted on the longitudinal beaded edge with the legs sewn to the longitudinal beaded edge by sewn stitches.

3. A slide fastener according to claim 2, each leg having a recess formed on the outer surface at the intermediate position, the sewn stitches running through the recesses of each leg.

4. A slide fastener according to claims 2 or 3, the slide fastener further including a separating device comprised of a separating box and an insert pin, the separating box including a box proper and a box pin mounted on the box proper on its one side so as to extend upward therefrom, the box proper having an insert hole formed therein on the other side to receive the insert pin for coupling the matching coupling element rows, the box pin being mounted on the lower end of one of the longitudinal beaded edges so as to continue from the relevant coupling element row, the insert pin being mounted on the lower end of the other longitudinal beaded edge so as to continue from the other coupling element row.

* * * * *